US006460846B2

(12) United States Patent
Yow et al.

(10) Patent No.: US 6,460,846 B2
(45) Date of Patent: Oct. 8, 2002

(54) REPRODUCTION MACHINE HAVING A SAFE TILTABLE PAPER TRAY

(75) Inventors: D. Gregory Yow, Wake Forest, NC (US); Lawrence A. Clark, Webster, NY (US); Jonathan T. Abbe, Webster, NY (US)

(73) Assignee: Xerox Corporation, Stamford, CT (US)

( * ) Notice: Subject to any disclaimer, the term of this patent is extended or adjusted under 35 U.S.C. 154(b) by 96 days.

(21) Appl. No.: 09/737,390

(22) Filed: Dec. 18, 2000

(51) Int. Cl.[7] ..... B65H 1/16; B65H 7/02
(52) U.S. Cl. ..... 271/155; 271/31
(58) Field of Search ..... 271/152, 153, 271/154, 155, 156, 162, 148, 30.1, 31

(56) References Cited

U.S. PATENT DOCUMENTS 4,711,443 A * 12/1987 Fujiwara et al. ..... 271/126
4,811,939 A * 3/1989 Keith ..... 271/146
5,839,015 A * 11/1998 Faguy et al. ..... 271/153
5,882,005 A * 3/1999 Araseki et al. ..... 271/126
6,186,492 B1 * 2/2001 Dechau et al. ..... 271/11
6,247,695 B1 * 6/2001 Linder et al. ..... 271/153
6,279,896 B1 * 8/2001 Linder et al. ..... 271/105
6,290,225 B1 * 9/2001 Linder et al. ..... 271/126

* cited by examiner

*Primary Examiner*—Michael R. Mansen
(74) *Attorney, Agent, or Firm*—Tallam I. Nguti

(57) ABSTRACT

A safe tiltable sheet feeding apparatus including a tiltable sheet support tray having a lead edge and a trail edge, for supporting a stack of sheets to be fed lead edge first from the stack. The tiltable sheet feeding apparatus also includes a feed head adjacent the sheet support tray for feeding a top sheet of the stack from the stack and an elevator assembly for independently raising, lowering and tilting the trail edge of the sheet support tray. The elevator assembly includes elevator drive motors, a controller, side frames defining lead edge elevator slots, and trail edge elevator slots. Importantly, the tiltable sheet feeding apparatus includes an overtilt safety sensor device mounted within the trail edge elevator slots and connected to the controller, for sensing overtilt of the trail edge of the sheet support tray, and for preventing resulting damage to the tiltable sheet feeding apparatus.

7 Claims, 4 Drawing Sheets

REPRODUCTION MACHINE HAVING A SAFE TILTABLE PAPER TRAY

BACKGROUND OF THE INVENTION

This invention relates generally to toner image reproduction machines, and more particularly to such a machine including a high capacity feeder having a safe tiltable paper tray.

In a typical toner image reproduction machine, for example an electrostatographic printing process machine, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document.

After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

The foregoing generally describes a typical black and white electrostatographic printing machine. With the advent of multicolor electrophotography, it is desirable to use an architecture which comprises a plurality of image forming stations. One example of the plural image forming station architecture utilizes an image-on-image (IOI) system in which the photoreceptive member is recharged, re-imaged and developed for each color separation. This charging, imaging, developing and recharging, re-imaging and developing, all followed by transfer to paper, is done in a single revolution of the photoreceptor in so-called single pass machines, while multi-pass architectures form each color separation with a single charge, image and develop, with separate transfer operations for each color.

In single pass color machines and other high-speed printers it is desirable to feed a wide variety of media for printing thereon. A large variety or latitude of sheet sizes and sheet weights, in addition to various coated and other specialty papers must be fed at high speed to the printer by sheet feeding apparatus that may involve tray tilting.

In the event of a system failure severe damage to the entire system is likely to occur unless the tray tilting drives are stopped.

SUMMARY OF THE INVENTION

In accordance with the present invention, there is provided a safe tiltable sheet feeding apparatus that includes a tiltable sheet support tray, having a lead edge and a trail edge, for supporting a stack of sheets to be fed lead edge first from the stack. The tiltable sheet feeding apparatus also includes a feed head adjacent the sheet support tray for feeding a top sheet of the stack from the stack and an elevator assembly for independently raising, lowering and tilting the trail edge of the sheet support tray. The elevator assembly includes elevator drive motors, a controller, side frames defining lead edge elevator slots, and trail edge elevator slots. Importantly, the tiltable sheet feeding apparatus includes an overtilt safety sensor device mounted within the trail edge elevator slots and connected to the controller, for sensing overtilt of the trail edge of the sheet support tray, and for preventing resulting damage to the tiltable sheet feeding apparatus

BRIEF DESCRIPTION OF THE DRAWING

Other features of the present invention will become apparent as the following description proceeds and upon reference to the drawings, in which.

DETAILED DESCRIPTION OF THE INVENTION

Figure 1:
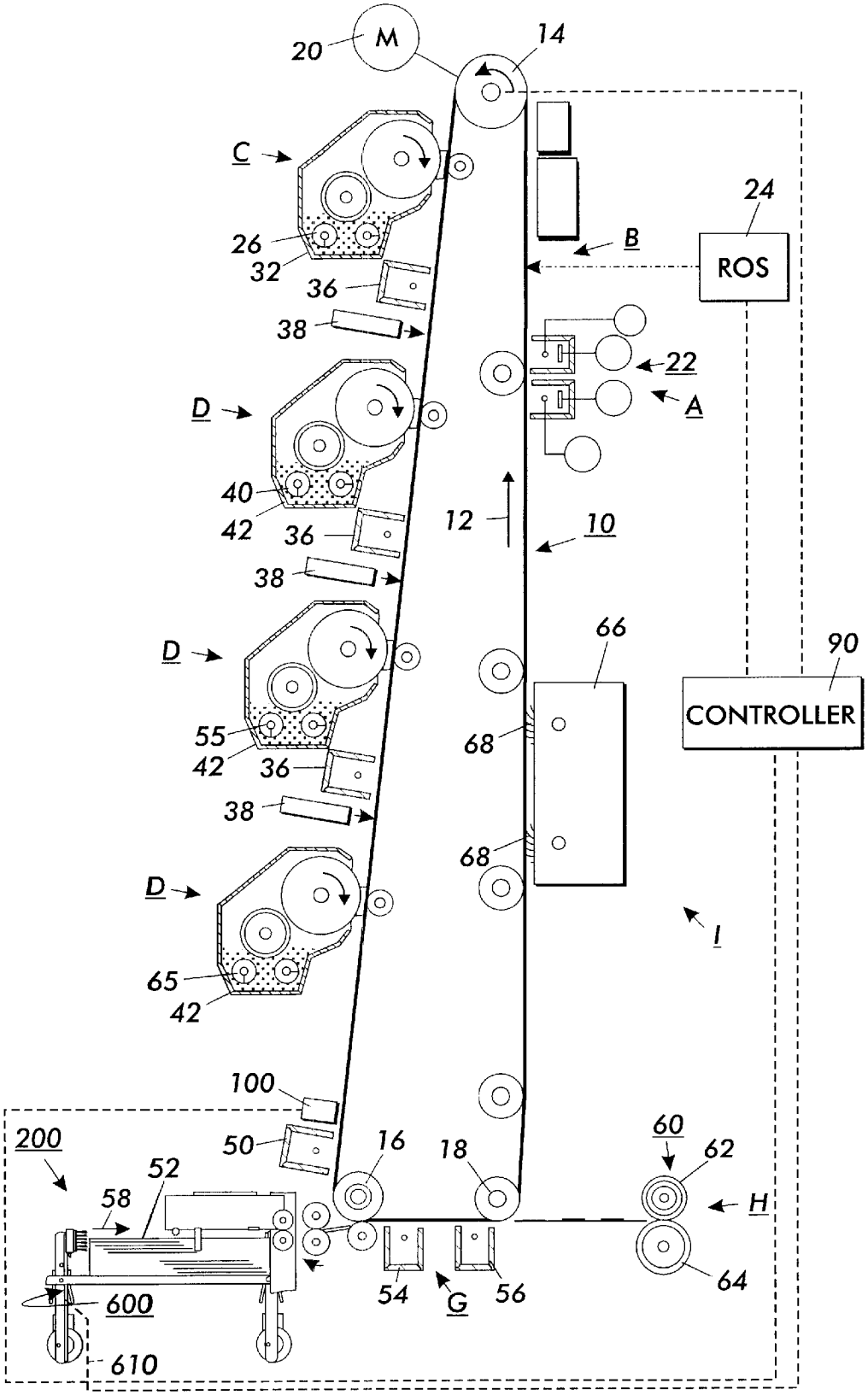
FIG. 1 is a schematic elevational view of a full color image-on-image single-pass electrostatographic printing machine including the safe tiltable sheet stack support and paper supply tray in accordance with the present invention.

Turning now to FIG. 1, the printing machine of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14, tension rollers 16 and fixed roller 18 and the roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relatively high, substantially uniform, preferably negative potential.

Next, the charged portion of photoconductive surface is advanced through an imaging/exposure station B. At imaging/exposure station B, a controller 90 receives the image signals representing the desired output image and processes these signals to convert them to the various color separations of the image to be reproduced. The color separations are then transmitted to a laser based output scanning device 24 causing the charge retentive surface to be discharged in accordance with the output from the scanning device. Preferably the scanning device is a laser Raster Output Scanner (ROS). Alternatively, the ROS could be replaced by other xerographic exposure devices such as LED arrays.

The photoreceptor, which is initially charged to a voltage $V_0$, undergoes dark decay to a level $V_{ddp}$ equal to about −500 volts. When exposed at the exposure station B it is discharged to $V_{expose}$ equal to about −50 volts. Thus after exposure, the photoreceptor contains a monopolar voltage profile of high and low voltages, the former corresponding to charged areas and the latter corresponding to discharged or background areas.

At a first development station C, developer structure, indicated generally by the reference numeral 32 utilizing a hybrid jumping development (HJD) system, the development roll, better known as the donor roll, is powered by two development fields (potentials across an air gap). The first field is the ac jumping field which is used for toner cloud generation. The second field is the dc development field which is used to control the amount of developed toner mass on the photoreceptor. The toner cloud causes charged toner particles 26 to be attracted to the electrostatic latent image. Appropriate developer biasing is accomplished via a power supply. This type of system is a noncontact type in which only toner particles (black, for example) are attracted to the latent image and there is no mechanical contact between the photoreceptor and a toner delivery device to disturb a previously developed, but unfixed, image.

The developed but unfixed image is then transported past a second charging device 36 where the photoreceptor and previously developed toner image areas are recharged to a predetermined level.

A second exposure/imaging is performed by device 24 which comprises a laser based output structure is utilized for selectively discharging the photoreceptor on toned areas and/or bare areas, pursuant to the image to be developed with the second color toner. At this point, the photoreceptor contains toned and untoned areas at relatively high voltage levels and toned and untoned areas at relatively low voltage levels. These low voltage areas represent image areas which are developed using discharged area development (DAD). To this end, a negatively charged, developer material 40 comprising color toner is employed. The toner, which by way of example may be yellow, is contained in a developer housing structure 42 disposed at a second developer station D and is presented to the latent images on the photoreceptor by way of a second HSD developer system. A power supply (not shown) serves to electrically bias the developer structure to a level effective to develop the discharged image areas with negatively charged yellow toner particles 40.

The above procedure is repeated for a third image for a third suitable color toner such as magenta and for a fourth image and suitable color toner such as cyan. The exposure control scheme described below may be utilized for these subsequent imaging steps. In this manner a full color composite toner image is developed on the photoreceptor belt.

Since some toner charge may not be totally neutralized, or the polarity thereof may be reversed, (thereby causing the composite image developed on the photoreceptor to consist of both positive and negative toner), a negative pre-transfer dicorotron member 50 is provided for conditioning the composite image in order to facilitate its effective transfer to a substrate.

Subsequent to image development a sheet of support material 52 is moved into contact with the toner images at transfer station G. The sheet of support material is advanced to transfer station G by the sheet feeding apparatus of the present invention, described in detail below. The sheet of support material is then brought into contact with photoconductive surface of belt 10 in a timed sequence so that the toner powder image developed thereon contacts the advancing sheet of support material at transfer station G.

Transfer station G includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52. After fusing, a chute, not shown, guides the advancing sheets 52 to a catch tray, stacker, finisher or other output device (not shown), for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I using a cleaning brush or plural brush structure contained in a housing 66. The cleaning brush 68 or brushes 68 are engaged after the composite toner image is transferred to a sheet. Once the photoreceptor is cleaned the brushes are retracted utilizing a device.

It is desirable in high speed color printers such as those described above to be able to feed a wide variety of sheet types for various printing jobs. Customers demand multiple sized stock, a wide range of paper weights, paper appearance characteristics ranging from rough flat appearing sheets to very high gloss coated paper stock. Each of these sheet types and size has its own unique characteristics and in many instances very different problems associated therewith to accomplish high speed feeding.

Figure 2:
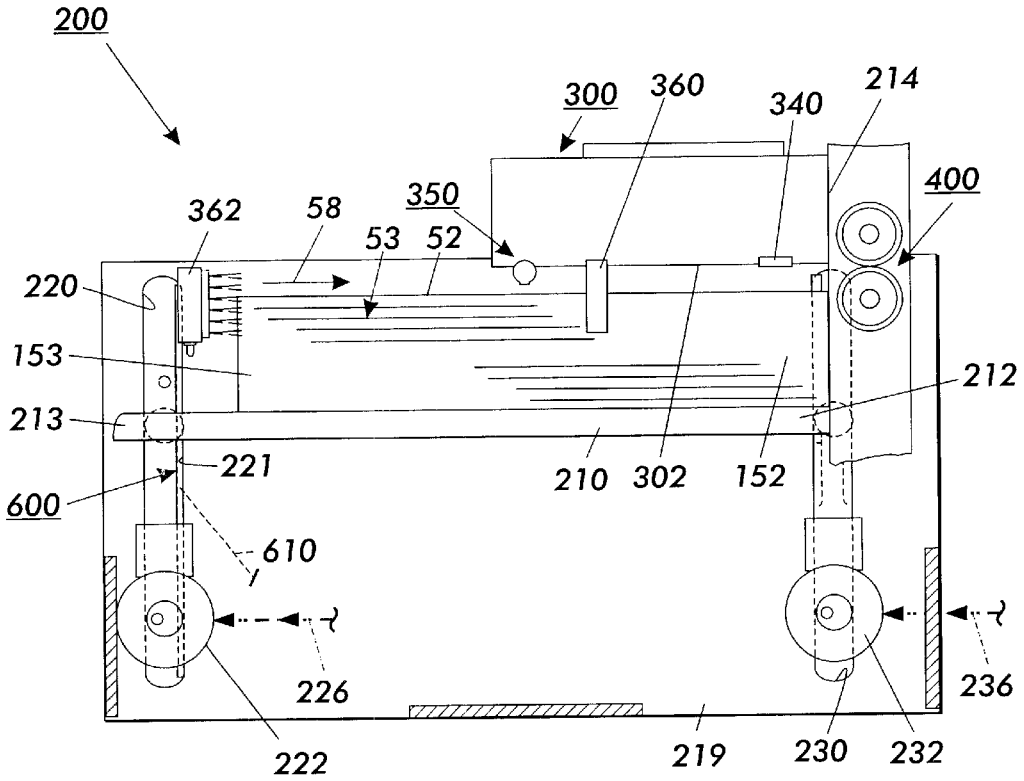
FIG. 2 is a side view illustrating the safe tiltable sheet stack support and paper supply tray in accordance with the present invention.

There is shown schematically in FIG. 2, a side elevational view of the safe tiltable paper tray or feeder of the present invention, generally indicated by reference numeral 200. As shown, the safe tiltable paper tray or feeder 200 includes a sheet support tray 210 which is tiltable and self adjusting to in order to accommodate various sheet types and characteristics; multiple tray elevator slots 220, 230 defined by side frames 219 (only one of which is shown), and elevator drives 222, 232 for raising, lowering and tilting a stack 53 of sheets supported on the tray 210; a vacuum shuttle feedhead 300; a lead edge multiple range sheet height sensor 340; a multiple position stack height sensor 350; a variable acceleration take away roll (TAR) 400; sheet fluffers 360, and an overtilt safety sensor device 600 of the present invention.

Figure 3:
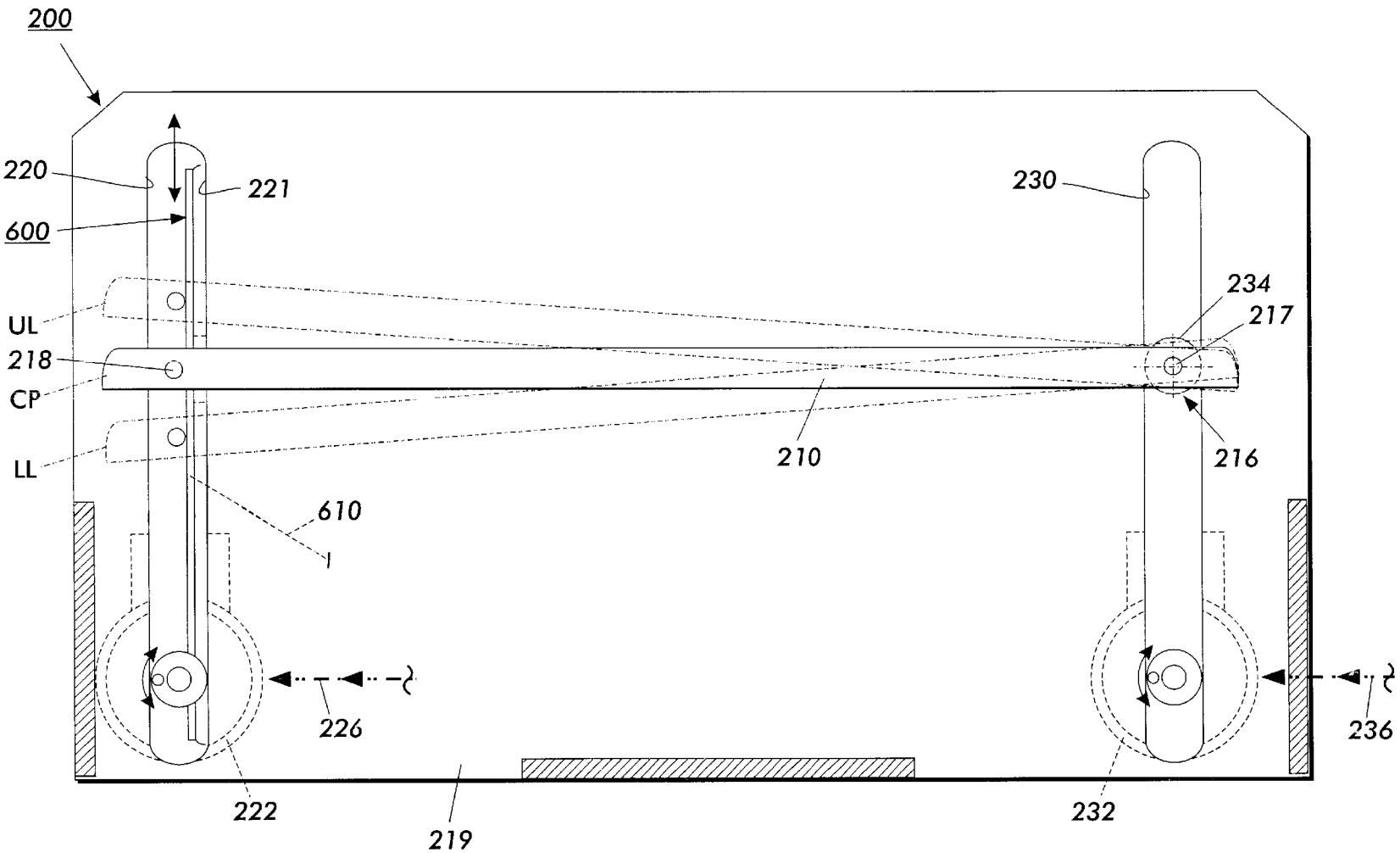
FIG. 3 is a detailed side view of the elevator drives for the safe tiltable sheet stack support and paper supply tray in accordance with the present invention.

Turning to FIG. 3, there is illustrated the general configuration of a multi-position stack height (contact) sensor (can detect 2 or more specific stack heights) in conjunction with a second sensor 340 near the stack lead edge which also senses distance to the top sheet (without sheet contact). The two sensors together enable the paper supply to position the stack 53 with respect to the acquisition surface 302 both vertically and angularly in the process direction. This height and attitude control greatly improves the capability of the feeder to cope with a wide range of paper basis weight, type, and curl.

Proper feeding with a top vacuum corrugation feeder (VCF) feedhead 300 requires correct distance control of the top sheets in the stack 53 from the acquisition surface and fluffer jets 360. The acquisition surface 302 is the functional surface on the feed head 300 or vacuum plenum.

Proper stack orientation requires the tray 210 to be tilted with the stack leading edge 152 being higher or lower than the stack trailing edge 153 thereof depending on whether there is down-curl or up-curl in the sheets in the stack 53 thereon. This tilting of the tray 210 brings the leading edge 152 of the top sheets of the stack 53 into proper location relative to the acquisition surface 302 of the feed head 300 and the fluffing jets. In order to institute the corrective tilting action, the height of the top sheet 52 near its leading edge 152 must be sensed, relative to the feed head 300, prior to acquisition and with the air system on and the stack "fluffed".

As seen in FIGS. 2–3, in the safe tiltable paper tray or feeder 200, the lead edge 212 and trail edge 213 of the support tray 210 are independently controlled by elevator drives 232, 222 respectively, which operate to raise, lower and/or tilt each such edge 212, 213. As illustrated, an elevator assembly (which include cross shafts 217 and 218, FIG. 3, and a belt not shown) are mounted for movement up and down through elevator slots 220, 230. The elevator assembly as such is driven by means of the two motors 222, 232 for independently controlling and tilting the LE 212, and TE 213 of the support tray 210. By tilting the tray 210 at an incline/upcline or decline/downcline respectively, the elevator drives 222, 232 can effectively compensate for severe up-curl/down-curl in the sheets on the stack. Tilting the tray in the manner illustrated also significantly reduces the number of multi-feeds for light weight media, and decreases the acquisition time for heavy weight papers.

The support tray 210 is initially tilted up on the lead edge 212 side, approximately 1.4° when paper is loaded. The initial angle is set at the maximum allowable angle while still maintaining stack capacity. If the paper was loaded in a flat tray and the tray 210 had to compensate for downcurl, the LE would be tilted up. By tilting up after the paper is loaded, the LE 152 of the stack 53 will be pulled away from the LE registration wall 214. Therefore, it is necessary to have an initial degree of tilt in the tray 210. By using a combination of sensors in the feedhead to detect proximity of the sheet stack, which can reflect the curl, the elevator is sent a signal to compensate for curl. Depending on the state of curl the elevator will tilt up/down for downcurl/upcurl, respectively. Tilting up to compensate for down curl will be limited to a maximum to prevent a large gap between the LE 152 of the paper and the LE registration wall 214.

Referring now to FIGS. 2–5, the pivot point 216 of the support tray 210 is located at the lead edge 212 thereof. A bearing (not shown) mounted on a lead edge cross shaft 217 which supports the tray 210, is located within an opening 234 in the tray 210, and within the lead edge elevator slot 230 as defined by side frames 219. The trail edge 213 of the support tray 210 has a trail edge cross shaft 218 that moves with the trail edge 213, and both are not constrained. Thus the trail edge 213, and trail edge shaft 218 are free to tilt or move pivotably up and down from a center position CP to an allowed lower limit position LL or to an allowed upper limit position UL within the trail edge elevator slot 220 defined by side frames 219 (only one of which is shown).

Thus as shown above, the tiltable paper tray or feeder 200 uses two stepper motors 222, 232 in an open loop 226, 236 with the controller 90 to control the attitude of the sheet stack support tray 210. In the event of a system failure, for example, where one of the motors 222, 232 stalls and the other continues to drive, severe damage to the entire system is likely to occur unless the other motor is stopped. Since no feedback is available in the open loop 226, 236 of the motors and controller, a cost effective and environmentally safe means is necessary for determining and counteracting support tray overtilt. A mercury switch could be used, however, a mercury switch poses an environmental problem, as well as being twenty times more expensive than using the preferred embodiment of a membrane sensor for the overtilt safety sensor device 600 of the present invention.

During tilting movements of the support tray 210, the trail edge motor 222 for example will index to a certain position and then the lead edge motor 232 will index either up or down in order to compensate for sheet curl as described above. All of this is of course accomplished through software and programming of the controller 90. If however there is any failure in the control system of either of the motors 222, 232, it is more than likely that severe hardware damage will result if the support tray 210 is allowed to overtilt or tilt too far out of specification. Therefore, in accordance with the present invention, an overtilt safety sensor device, preferably in the form of a membrane sensor, 600 is provided and located at strategic and desired positions for preventing such undesirable support tray overtilt.

As shown, the overtilt safety sensor device or membrane sensor 600 is mounted within the trail edge elevator slot 220, defined by side frames 219, and strategically where the trail edge cross shaft 218 (at the trail edge 213 of the support tray 210) will make contact therewith when at the allowed lower limit LL, or at the allowed upper limit UL, when being tilted as above. As the support tray 210 tilts in the LE-TE direction, the trail edge shaft 218 is pulled closer to the lead side 221 of the trial edge elevator slot 220. If the trail edge shaft 218 is pulled too close to the lead side 221 of the trail edge elevator slot 220, the membrane sensor device 600 will be actuated, and will send an output signal along means 610 to the controller 90. The controller 90 then declares a system fault and takes appropriate action, thereby preventing serious damage to the paper supply subsystem.

For example, if the support tray 210 overtilts either up or down, its trail edge 213, specifically the trail edge shaft 218, will contact and actuate the overtilt safety sensor device 600, and for example, cause the sensor device 600 to send out a signal 610 that enables the controller 90 to cut power to the elevator motors 222, 232, thus preventing severe hardware damage and failure. As such, the overtilt safety sensor device 600 provides a cost effective and environmentally safe way for preventing the support tray 210 from tilting out of specification if there is a system failure.

Figure 4:
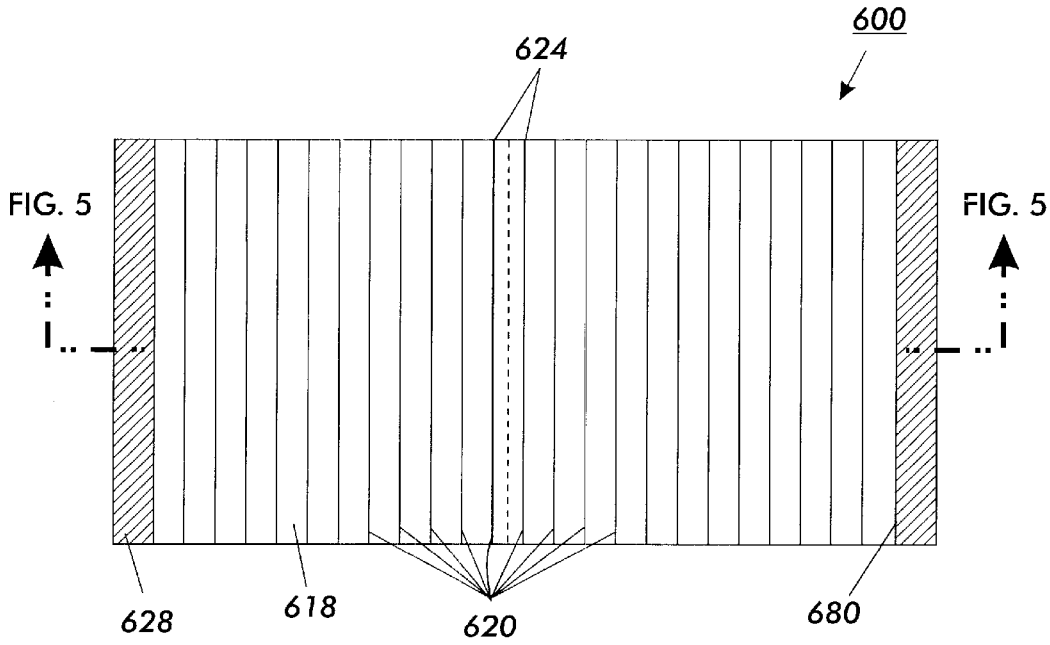
FIG. 4 is a plan view of a portion of the membrane sensor device of the safe tiltable sheet stack support and paper supply tray in accordance with the present invention.
Figure 5:
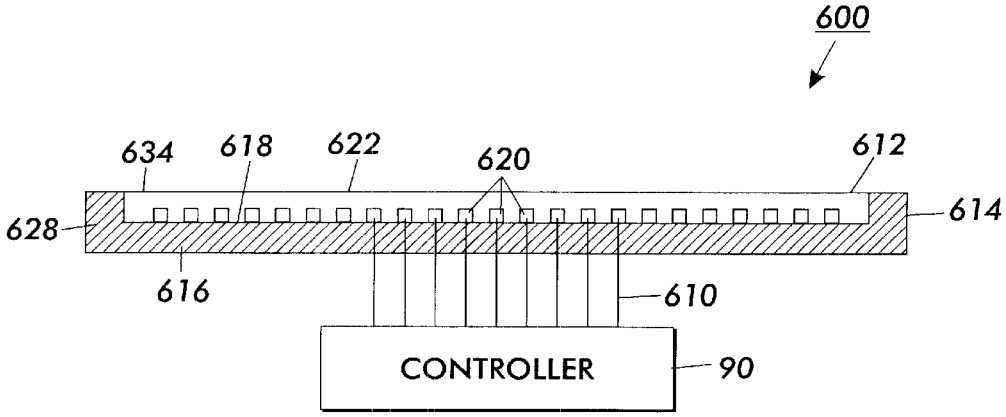
FIG. 5 is a sectional view (along view plane 5—5 FIG. 4) of the portion of the membrane sensor device in accordance with the present invention.

Referring now to FIGS. 4 and 5, an exemplary embodiment of a membrane or pressure sensor device 600 is shown and is suitable for use as the overtilt safety sensor in accordance with the invention. As illustrated, the pressure sensor 600 as shown includes a conductive sensor membrane 612 spaced from a sensing assembly 614 by a spacer layer 628. The sensing assembly 614 includes an electrode substrate 616 having an electrode surface 618 and an electrode set 622 including a plurality of electrodes 620. The pressure sensor 600 also includes a sensing area 634. Each of the electrodes 620 is connected by means 610 to a signal processor, such as the controller 90 as shown in FIG. 1. As shown in FIG. 5, the electrode substrate 616 and the spacer layer 628 may be integrally formed.

Each of the plurality of electrodes 620 in the pressure sensor 600 may be, and preferably are linearly arranged parallel to each other. As pressure is applied to the sensor membrane 612 to deform the sensor membrane 612 toward the linear electrodes 620, the sensor membrane 612 will make both mechanical and electrical contact with selected ones of the electrodes 620. The specific ones of the electrodes 620 contacted by the sensor membrane 612 will depend on the particular point LL, UL, (FIGS. 2 and 3) at which the pressure is applied to the sensor membrane 612.

Since the electrodes 620 are connected (610) to the signal processor or controller 90, when any of the electrodes 620 are contacted by the sensor membrane 612 this condition may be sensed by the controller 90, which then outputs an appropriate output signal indicative of this condition.

Ordinarily, the sensor membrane 612 will be in an undeformed rest position when no pressure is applied to the sensor membrane 612. The sensor membrane 612 is shown in such a rest position in FIG. 5. Due to the resilient nature of the sensor membrane 612, and to the manner in which the sensor membrane 612 is supported by the spacer layer 628, as pressure is gradually applied to the sensor membrane 612, the first electrode to be contacted will be the center electrode 624.

As can be seen, there has been provided a safe tiltable sheet feeding apparatus is provided and includes a tiltable sheet support tray having a lead edge and a trail edge, for supporting a stack of sheets to be fed lead edge first from the stack. The tiltable sheet feeding apparatus also includes a feed head adjacent the sheet support tray for feeding a top sheet of the stack from the stack and an elevator assembly for independently raising, lowering and tilting the trail edge of the sheet support tray. The elevator assembly includes elevator drive motors, a controller, side frames defining lead edge elevator slots, and trail edge elevator slots. Importantly, the tiltable sheet feeding apparatus includes an overtilt safety sensor device mounted within the trail edge elevator slots and connected to the controller, for sensing overtilt of the trail edge of the sheet support tray, and for preventing resulting damage to the tiltable sheet feeding apparatus.

While the present invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A safe tiltable sheet feeding apparatus comprising:

(a) a tiltable sheet support tray for supporting a stack of sheets to be fed lead edge first from the stack, said tiltable sheet support tray having a lead edge and a trail edge;

(b) a feed head adjacent said sheet support tray for feeding a top sheet of the stack from the stack;

(c) an elevator assembly for independently raising, lowering and tilting said trail edge of said sheet support tray, said elevator assembly including elevator drive motors, a controller, side frames defining lead edge elevator slots, and trail edge elevator slots; and (d) an overtilt safety sensor device mounted within said trail edge elevator slots and connected to said controller, for sensing overtilt of said trail edge of said sheet support tray, and for preventing resulting damage to the tiltable sheet feeding apparatus.

2. The safe tiltable sheet feeding apparatus of claim 1, wherein said sheet support tray includes a lead edge support shaft forming a pivot for tilting movement of said sheet support tray.

3. The safe tiltable sheet feeding apparatus of claim 2, wherein said lead edge support shaft is mounted within said side frames defining lead edge elevator slots.

4. The safe tiltable sheet feeding apparatus of claim 1, wherein said elevator assembly includes a lead edge elevator drive motor and a trail edge elevator drive motor.

5. The safe tiltable sheet feeding apparatus of claim 1, wherein said overtilt safety sensor device comprises a membrane sensor device.

6. The safe tiltable sheet feeding apparatus of claim 5, wherein said membrane sensor device comprises a conductive membrane, a spacer layer and an electrode substrate including a plurality of electrodes connected to said controller.

7. An electrostatographic reproduction machine for producing toner images on copy sheets, the electrostatographic reproduction machine comprising:

(a) a moveable image bearing member having an image bearing surface;

(b) means for forming a toner image on said image bearing surface and for transferring said toner image onto a copy sheet of paper; and (c) a safe tiltable sheet feeding apparatus for holding and feeding copy sheets to receive said toner image, said safe tiltable sheet feeding apparatus including:

(i) a tiltable sheet support tray for supporting a stack of sheets to be fed lead edge first from the stack into toner image receiving relationship with said image bearing member, said tiltable sheet support tray having a lead edge and a trail edge;

(ii) a feed head adjacent said sheet support tray for feeding a top sheet of the stack from the stack;

(iii) an elevator assembly for independently raising, lowering and tilting said trail edge of said sheet support tray, said elevator assembly including elevator drive motors, a controller, side frames defining lead edge elevator slots and trail edge elevator slots; and (iv) an overtilt safety sensor device mounted within said trail edge elevator slots and connected to said controller, for sensing overtilt of said trail edge of said sheet support tray, and for preventing resulting damage to the tiltable sheet feeding apparatus.

* * * * *